US008696089B2

(12) United States Patent
Jones et al.

(10) Patent No.: US 8,696,089 B2
(45) Date of Patent: Apr. 15, 2014

(54) PORTABLE PRINTER FOR DIRECT IMAGING ON SURFACES

(75) Inventors: Brent R. Jones, Sherwood, OR (US); Edward Francis Burress, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 51 days.

(21) Appl. No.: 13/493,347

(22) Filed: Jun. 11, 2012

(65) Prior Publication Data

US 2013/0328953 A1 Dec. 12, 2013

(51) Int. Cl.
*B41J 23/00* (2006.01)

(52) U.S. Cl.
USPC ..... 347/37

(58) Field of Classification Search
CPC ..... B41J 3/36; B41J 29/02; B41J 25/308
USPC ..... 347/9, 16, 37, 101, 104, 108, 109
See application file for complete search history.

(56) References Cited

U.S. PATENT DOCUMENTS

| | | | | |
|---|---|---|---|---|
| 3,873,769 | A | 3/1975 | Cotter | |
| 5,402,351 | A | 3/1995 | Batchelder et al. | |
| 6,116,707 | A * | 9/2000 | Avida | 346/139 R |
| 6,403,002 | B1 | 6/2002 | van der Geest | |
| 6,612,824 | B2 | 9/2003 | Tochimoto et al. | |
| 7,240,985 | B2 | 7/2007 | Rogers, IV | |
| 8,017,055 | B2 | 9/2011 | Davidson et al. | |
| 8,061,297 | B2 | 11/2011 | Albertalli et al. | |
| 2002/0196482 | A1 | 12/2002 | Hoberock et al. | |
| 2005/0280185 | A1 | 12/2005 | Russell et al. | |
| 2009/0101027 | A1 | 4/2009 | Goetz et al. | |

* cited by examiner

*Primary Examiner* — An Do
(74) *Attorney, Agent, or Firm* — Maginot, Moore & Beck, LLP

(57) ABSTRACT

A portable imaging device has been developed. The portable imaging device enables a printhead to be mounted to a surface to print an image on the surface. The printhead moves in two or more directions while mounted on the printing surface enable the printhead to eject ink onto the surface to form the image on the surface.

19 Claims, 4 Drawing Sheets

PORTABLE PRINTER FOR DIRECT IMAGING ON SURFACES

TECHNICAL FIELD

This disclosure relates to printers and, more particularly, to printers configured to print on large surfaces.

BACKGROUND

Large planar surfaces, such as windows, doors, walls, cars, semis, vans, and buses, are often used by businesses as an advertisement or decorative medium. These large planar surfaces may contain images of decorations, current prices, products, company names, phone numbers, and other information relevant to customers. Some of this information is prone to frequent changes. Thus, many of the advertisements and decorations are temporary, intended for a short term sale or event, or as a seasonal decoration.

Images on large planar surfaces may be hand-drawn, meaning that a person directly applies paint or other colorant to the surface. However, hand-drawing an image on a large surface can be time consuming. The quality of the image is limited by the artistic abilities of the person drawing the image, and obtaining a skilled artist to draw the image is often expensive, and, for a temporary image, impractical. Furthermore, if the image becomes damaged or needs to be changed, the same artist may be needed to repair the image. If the same artist is unavailable, the image may be of poor quality after the image is repaired or modified.

Images on large planar surfaces may also be printed by a printer. Because the surface is too large and rigid to be fed through a printer, the image is first printed on a sheet of vinyl or plastic by a conventional inkjet or xerographic printing process. The sheet is then attached to the vehicle, window, or other large planar surface with adhesives for display. Application of the sheet, however, can be labor intensive to ensure that no defects are generated in the image placement. Furthermore, modifications or repairs of the printed image are not possible without replacing the entire image. Therefore improved image generation on large planar surfaces is desired.

SUMMARY

A portable printer has been developed that enables printing of surfaces in diverse environments. The printer includes a frame, a printhead operatively connected to the frame and configured to eject ink onto a printing surface, the printhead being movable in a first direction and a second direction, the first and second directions being substantially parallel to the printing surface, and an attachment mechanism configured to selectively couple the frame to the printing surface to position the printhead a predetermined distance from the printing surface to enable the printhead to eject ink onto the printing surface.

A method of using the printer enables printing of surfaces in diverse environments. The method includes attaching a frame to a printing surface, the frame being operatively connected to a printhead, moving the printhead within the frame in a first direction that is substantially parallel to the printing surface, moving the printhead within the frame in a second direction that is substantially parallel to the printing surface and perpendicular to the first direction, and operating the printhead to eject ink on the printing surface to form an image as the printhead moves in the first and second directions.

DETAILED DESCRIPTION

Figure 1:
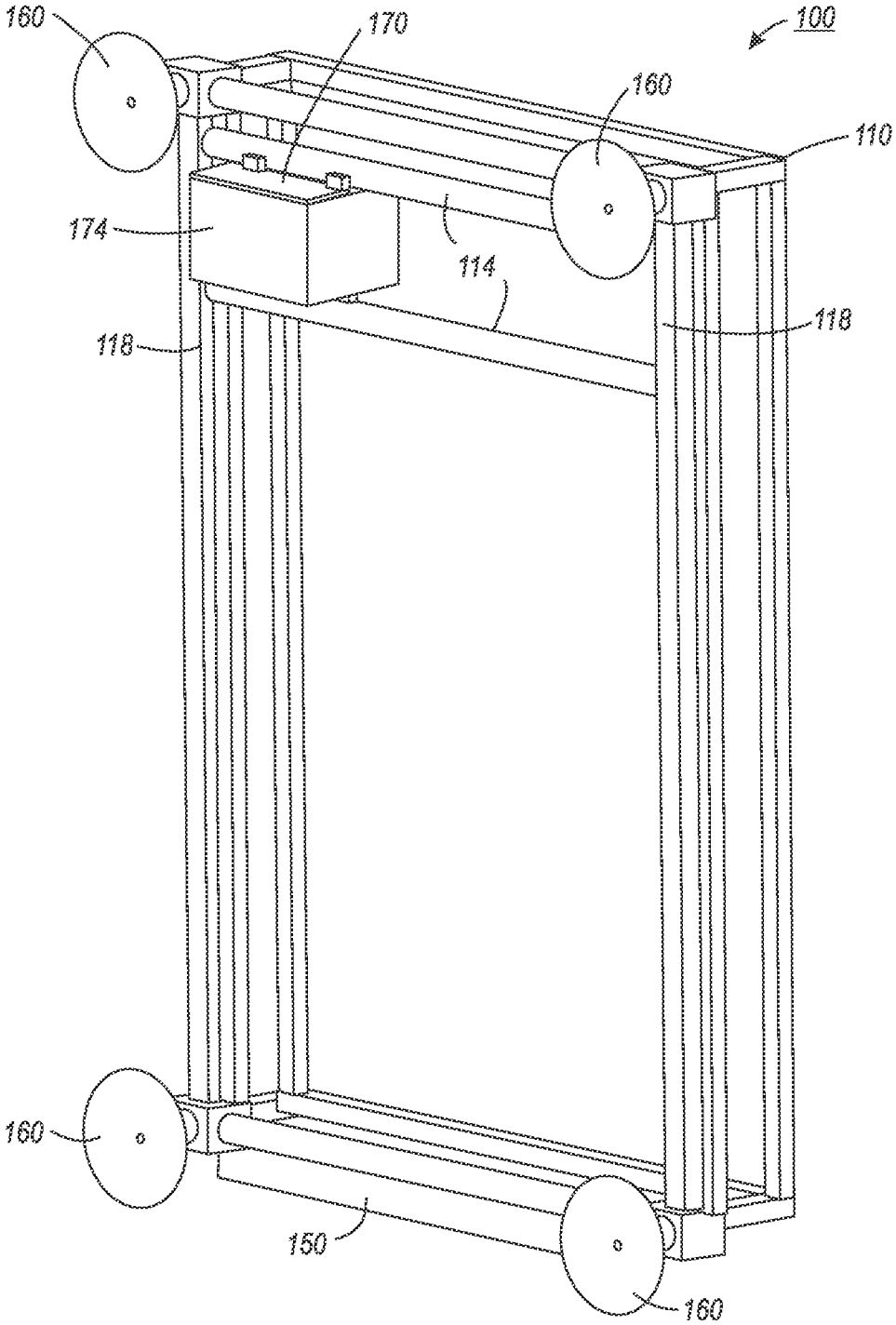
FIG. 1 is a front perspective view of a portable imaging system.

For a general understanding of the environment for the apparatus and method disclosed herein as well as the details for the apparatus and method, reference is made to the drawings. In the drawings, like reference numerals have been used throughout to designate like elements.

As used herein, the term "ink" refers to a colorant that is liquid when applied to an image receiving surface. For example, ink can be aqueous ink, ink emulsions, solvent based inks, gel inks, UV cured inks, sugar or vegetable based inks, and phase change inks. The ink can also be permanent or the ink can be temporary, intended to be washed off. "Phase change ink" refers to inks that are in a solid or gelatinous state at room temperature and that change to a liquid state when heated to an operating temperature for application or ejection onto an image receiving surface. The phase change inks return to a solid or gelatinous state when cooled on the print media after the printing process.

FIG. 1 depicts a portable imaging device 100. The portable imaging device 100 includes a frame 110, an electronics housing 150, four suction cups 160, and a printhead assembly 170. The frame 110 is configured to provide a rigid support structure for the portable imaging device 100 and printhead X-axis rails 114 and printhead Y-axis rails 118. In a printing orientation where the imaging device 100 is mounted on a vertical surface the X-axis is substantially horizontal and the Y-axis is substantially vertical. The descriptors "horizontal" and "vertical" are used herein for the X and Y axes, respectively, but any orientation of the device 100 is possible and the device 100 can be configured with the orientation of the axes reversed or rotated. Additionally, the horizontal and vertical directions are orthogonal to one another in the same plane. Printing can be done on a vertical surface, such as, a window or a wall, or printing can be done on horizontal or angled surfaces, such as, a vehicle top surface or sloped window. In one embodiment, the frame is 24 inches wide by 36 inches tall, although in other embodiments the frame can be sized differently. The vertical rails 118 extend substantially from the bottom to the top of the frame 110 vertically, with one rail 118 on each end of the frame. The horizontal rails 114 are operatively connected to the vertical rails 118 and extend across the width of the frame 110. The horizontal rails 114 are located at a distance to enable the printhead assembly 170 to be movably mounted between the rails 114, and the horizontal rails 114 are configured to move vertically within the vertical rails 118 and frame 110. Suction cups 160 attach to the vertical rails 118 and frame 110 at the corners of the frame 110 to provide an attachment mechanism for coupling the printer 100 to a printing surface.

The electronics housing 150 is mounted on the bottom of the frame 110 in the embodiment of FIG. 1. In other embodiments, however, the electronics housing 150 is located on a side of, on top of, or within the frame. The electronics housing 150 contains electronic components that enable operation of the imaging device 100, including a controller, memory, and power supply. The controller and other electronics are operatively connected to the printhead assembly 170 by wires and cables supported by the horizontal 114 and vertical 118 rails or the frame 110. The electronics housing 150 can also include actuators that are configured to move the printhead assembly 170 within the horizontal 114 and vertical 118 rails. The actuators located in the electronics housing 150 are operatively connected to the horizontal 114 and vertical 118 rails by belts, gears, or other known coupling and drive components.

The printhead assembly 170 includes a printhead face 174 in which a plurality of inkjets are arranged and configured to eject ink onto the surface to which the imaging device 100 is attached. The inkjets in the printhead assembly 170 can be piezoelectric inkjets that are configured to eject ink drops in response to a mechanical force generated by a piezoelectric transducer positioned in each inkjet. The printhead assembly 170 can include inkjets configured to eject a single color of ink, or the printhead assembly 170 can include multiple arrays of inkjets configured to eject different colors of ink, such as black, cyan, magenta, and yellow, to enable the printhead 170 to eject ink to form a color image. The printhead assembly 170 includes at least one ink storage and delivery system for each color of inkjet in the printhead face 174 to supply ink to the inkjets. The printhead assembly 170 can also include one or more heaters to enable the printhead assembly 170 to melt phase change ink or heat liquid ink to a predetermined temperature for delivery to the inkjets and ejection to the printing surface.

The actuators in the electronics housing 150 are configured to move the printhead assembly 170 in the horizontal and vertical directions within the horizontal 114 and vertical 118 rails. In one embodiment, friction drive mechanisms are used to move the printhead within the rails 114, 118, although in other embodiments, gears, belts, pulleys, or any suitable combination of gears, belts, pulleys, friction drive or other known motion and drive elements are configured to move the printhead assembly 170. The printhead assembly 170 can be manually adjusted in the direction normal to the printing surface to position the printhead face 174 at a predetermined distance from the printing surface that is suitable for printing on the surface. Alternatively, as described below, a drive system can be utilized to move in the normal or "Z" axis to establish printer distance to the image receiving surface. The inkjets in the printhead face 174 eject ink onto the printing surface as the printhead assembly 170 moves within the rails to form an image on the printing surface. The imaging device 100 can be further configured to eject two or more layers of solid ink on a surface to generate a three dimensional image, the depth of which can be facilitated by one or more Z-axis adjustments as the image height increases. Once the image is completed, the suction cups 160 are disengaged from the printing surface and the portable imaging device 100 can be stored, used at another location, or adjusted in position to extend the initial image, enabling the overall printed image size to be larger than the printing range of the horizontal and vertical travel.

Figure 2:
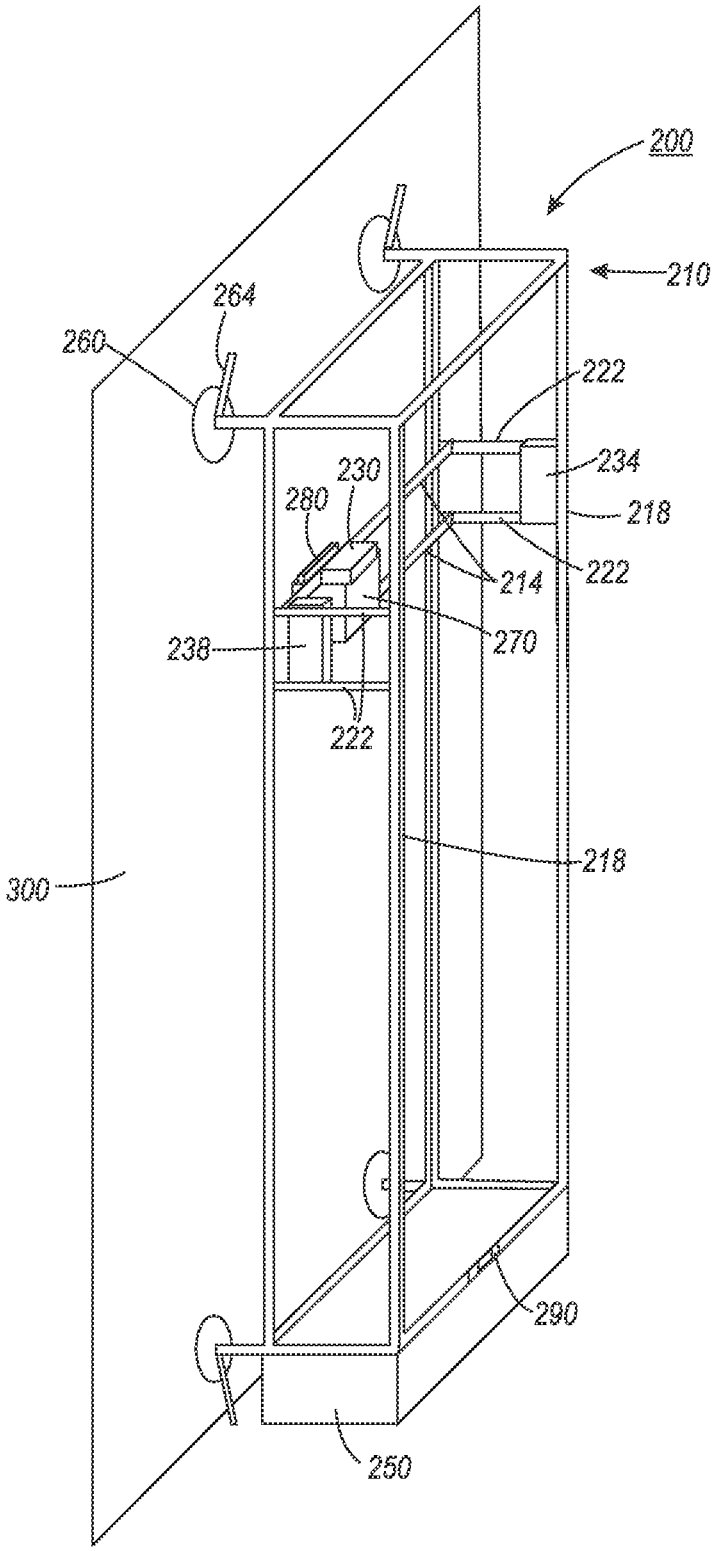
FIG. 2 is a side perspective view of another portable imaging system.

FIG. 2 depicts another portable imaging device 200. The portable imaging device 200 includes a frame 210, an electronics housing 250, four suction cups 260, and a printhead assembly 270. The frame 210 is configured to provide a rigid support structure for the portable printer. The frame 210 can be formed of aluminum or other materials that are lightweight and rigid. Horizontal rails 214 and normal rails 222 are attached to the frame, while vertical rails 218 are integrated into the frame 210.

Four suction cups 260 are fixedly mounted on the frame 210 and configured to attach the portable imaging device 200 to a printing surface 300. The suction cups 260 each include a clamp lever 264 configured to force air out of the suction cup 260 when the suction cup 260 is pressed against the printing surface 300, generating a vacuum inside the suction cup to retain the frame 210 on the surface 300. The portable imaging device illustrated has four suction cups, but there can be more or less suction cups depending on the size and weight of the portable imaging device. A smaller size printer can be configured with two or three suction cups for example, while a large or heavy device can include five or more suction cups. In other practical embodiments the suction cups can be pneumatically operated with an on-board pump or external vacuum source or the suction cups can be of a manual lever actuated configuration. Alternatively, the suction cups can be replaced with clamps or an elastomeric "bumper" configured to attach to or be held against the surface of an object to be printed by an external device, such as a fork lift.

The electronics housing 250 is mounted on the bottom of the frame 210 in the illustrated embodiment. In other embodiments, however, the electronics housing is located on a side of, on top of, or within the frame. The electronics housing 250 includes electronics components that operate the printer, including a controller and memory. The controller and other electronics are operatively connected to the printhead assembly 270 by wires and cables that can be supported by the horizontal 214, vertical 218, and normal 222 rails, and the frame 210. The frame and support rails can be attached to or formed as part of panels to partially or completely enclose the portable imaging device to increase rigidity of the frame, protect the components within, and reduce risk of interference with the printing and potential safety hazards that may be associated with such printing.

The printhead assembly 270 includes a plurality of inkjet ejectors located in a face of the printhead assembly 270 that are configured to eject ink onto the printing surface 300. The inkjets in the printhead face 274 eject ink onto the printing surface as the printhead assembly 270 moves within the frame 210 to form an image on the printing surface 300. The inkjets in the printhead can be piezoelectric inkjets that are configured to eject ink drops in response to a mechanical force generated by a piezoelectric transducer positioned in each inkjet. The printhead assembly 270 can include inkjets configured to eject a single color of ink, or the printhead assembly 270 can include multiple arrays of inkjets configured to eject different colors of ink, such as black, cyan, magenta, and yellow, to enable imaging device 200 to form a color image on the printing surface 300. The printhead assembly 270 includes at least one ink storage and delivery system for each color of inkjet in the printhead face to supply ink to the inkjets. The printhead assembly 270 can also include one or more heaters to enable the printhead assembly 270 to melt phase change ink or heat liquid ink to a predetermined temperature for delivery to the inkjets and ejection to the printing surface 300.

An optical sensor 280 is configured to generate digital image data corresponding to light reflected from the planar surface. The optical sensor can include an illumination source that directs light towards the surface and receives reflected light. The optical sensors can generate and detect light within and/or outside the visible light wavelength range. The digital image data generated by sensor 280 is delivered to a controller in the electronics housing 250. The controller is configured with programmed instructions stored in a memory operatively connected to the controller to process the image data to identify characteristics of the image, for example, edges and bounded areas or regions in the image on the planar surface. The controller then generates signals to operate actuators to move the printhead assembly 270 to a particular location over the surface 300 and also generates driving signals to operate inkjets in the printhead assembly 270 for the ejection of ink on the surface 300. In one embodiment the optical sensor is mounted on the printhead assembly 270, although in other embodiments the sensor is fixed to the frame or configured to move within the frame independent of the printhead assembly. Processing of the image data generated by the sensor 280 enables the portable imaging device 200 to assess the quality of the image as the image is printed and/or to print an image adjacent to an image detected on the printing surface 300 to extend, repair, and/or modify the detected image.

The portable printer can be oriented essentially horizontal or vertical for many images, such as descriptive text and pricing information. To facilitate placement of the printer on a surface, the imaging device 200 includes a level indicator 290. In the illustrated embodiment, the level indicator 290 is a bubble type level read by the user to position the imaging device. In other practical embodiments the level indicator can be an electronic level, for example an accelerometer, which generates an electronic signal that is delivered to the controller. The controller can then provide visual or audible signals to the user through a display or speaker indicating which end to drop or elevate to establish a level condition, or the controller can be configured to adjust the movement of the printhead and the operation of the inkjet ejectors in the printhead with reference to the alignment of the imaging device.

The printhead assembly 270 is mounted on the horizontal rails 214 and configured to move in the horizontal, vertical, and normal directions within the horizontal 214, vertical 218, and normal rails 222 by actuators 230, 234, 238, respectively. The normal direction refers to a direction that is orthogonal to both the horizontal and vertical directions. The actuators 230, 234, 238 each include a friction drive mechanism that includes a plurality of rotating wheels configured to engage the corresponding rails 214, 218, 222 under compression. The friction drive wheels can be spring loaded against the rails to establish friction and they can be formed of an elastomer material. The actuator rotates the wheel to move the rails and printhead assembly in the desired direction. Vertical drive actuator 234 is mounted on the normal rails 222 and configured to move the normal rails 222, horizontal rails 214, and printhead assembly 270 vertically within the frame 210 by driving wheels in the vertical rails 218. The normal drive actuator 238 is mounted on the horizontal rails 214 and configured to move the printhead assembly 270 in the normal direction by moving a wheel within the normal rails 222. The normal drive actuator 238 is configured to position the printhead assembly 270 at a predetermined distance from a printing surface 300 to enable inkjets in the printhead to eject ink onto the printing surface 300. The vertical drive actuator 238 enables the printhead to be positioned at the predetermined distance to adjust for ink build-up on the surface in three dimensional printing and for printing on a moderately non-planar surface, such as a vehicle windshield. The horizontal drive actuator 230 is mounted on the printhead assembly 270 and is configured to move the printhead assembly 270 horizontally within the frame 210 by turning one or more wheels compressed in the horizontal rails 214.

Figure 3:
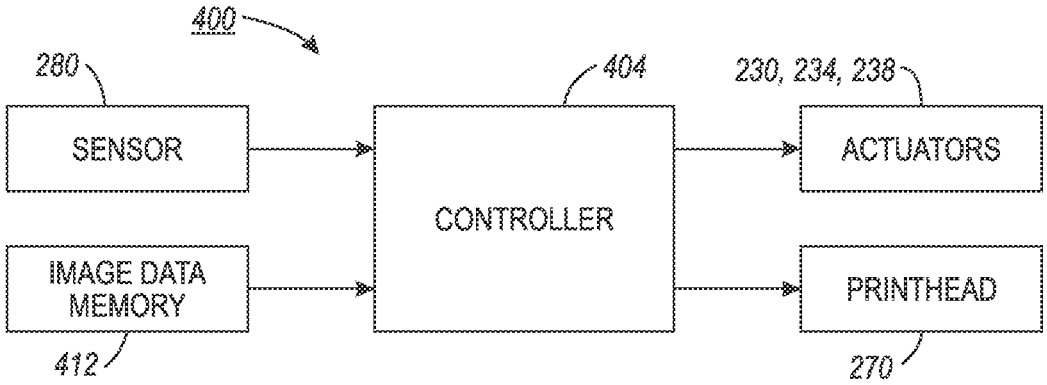
FIG. 3 is a schematic view of the portable imaging system of FIG. 2.

FIG. 3 is a schematic diagram of a control system 400 for the portable imaging device 200. A controller 404 receives image data for images to be printed from image data memory 412 and the digital image data generated by the optical sensor 280. The image data memory 412 can be transferred from another computer, portable memory storage device, or other electronic device suitable for delivering image data to the controller 404. The controller 404 generates the driving signals to operate the inkjet ejectors in the printhead assembly 270 to eject ink at particular locations with reference to the image data for the image to be printed and the digital image data generated by the optical sensor. The controller 404 also generates electrical signals to operate the actuators 230, 234, 238 to move the printhead assembly 270 to locations where ink is to be ejected. The controller 404 can be implemented with general or specialized programmable processors that execute programmed instructions. The instructions and data required to perform the programmed functions are stored in memory 408 associated with the processors or controllers. The processors, memories, and interface circuitry configure the controllers to perform the functions described above. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Figure 4:
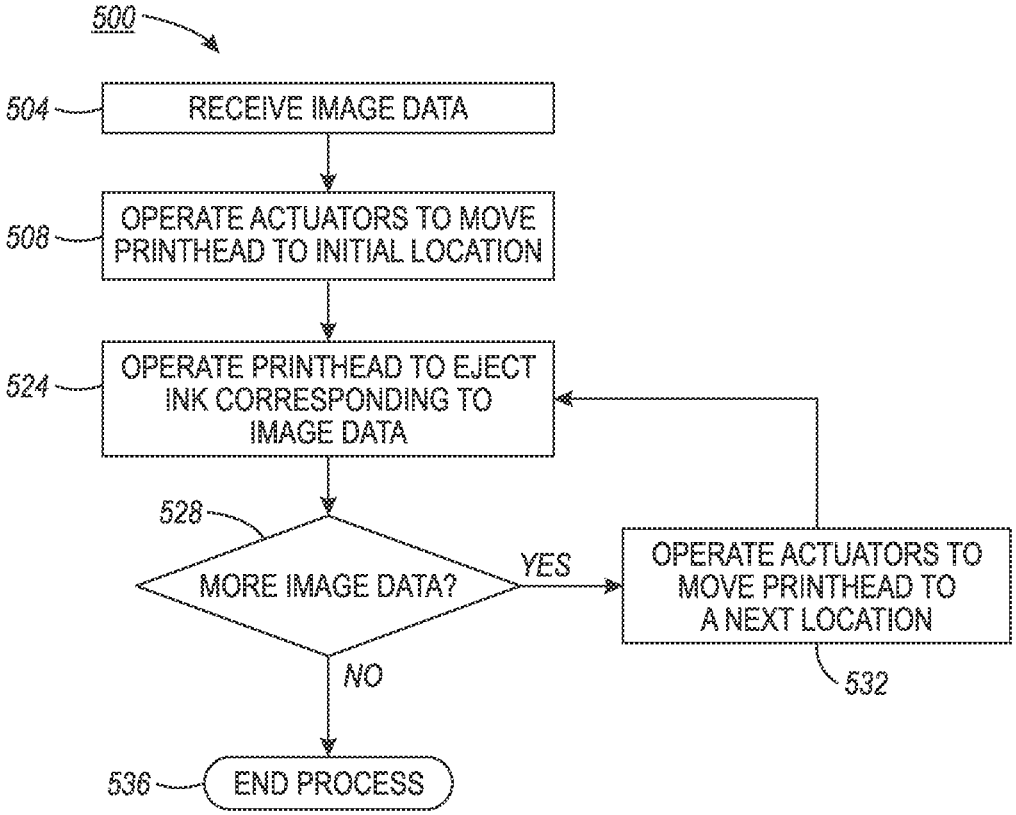
FIG. 4 is a block diagram of a printing process for the portable imaging system of FIGS. 2 and 3.

FIG. 4 depicts a process 500 for printing an image onto a printing surface. As used in this document, a reference to a process performing or doing some function or event refers to a controller executing programmed instructions stored in a memory operatively connected to the controller to operate electronic components operatively connected to the controller to perform the function or event. Process 500 is described with reference to the printhead assembly 270, actuators 230, 234, 238, image data stored in image data memory 412, and controller 404 of FIG. 2 and FIG. 3 for illustrative purposes. The two dimensional imaging process described below is contemplated for a portable imaging device having only two axis X-Y actuators for printhead motion, which is appropriate for printing on flat planar surfaces, such as, a building window.

The controller 404 receives image data from image data memory 412 corresponding to an image to be printed onto a printing surface (block 504). The image data can be stored in memory 408 or another memory in the imaging device. The controller 404 operates the actuators 230, 234, 238 to move the printhead assembly 270 to an initial location (block 508). The controller operates the inkjets in the printhead to eject ink onto the printing surface corresponding to the image data received from the memory 412 (block 524) to form the image on the printing surface. The controller 404 then determines if additional image data 412 are ready for processing (block 528). If additional image data 412 are read to process, the controller operates the actuators 230, 234, 238 to move the printhead assembly 270 to a next location (block 532) and the process continues at block 524. If no more image data are ready, then the process 500 terminates (block 536).

Figure 5:
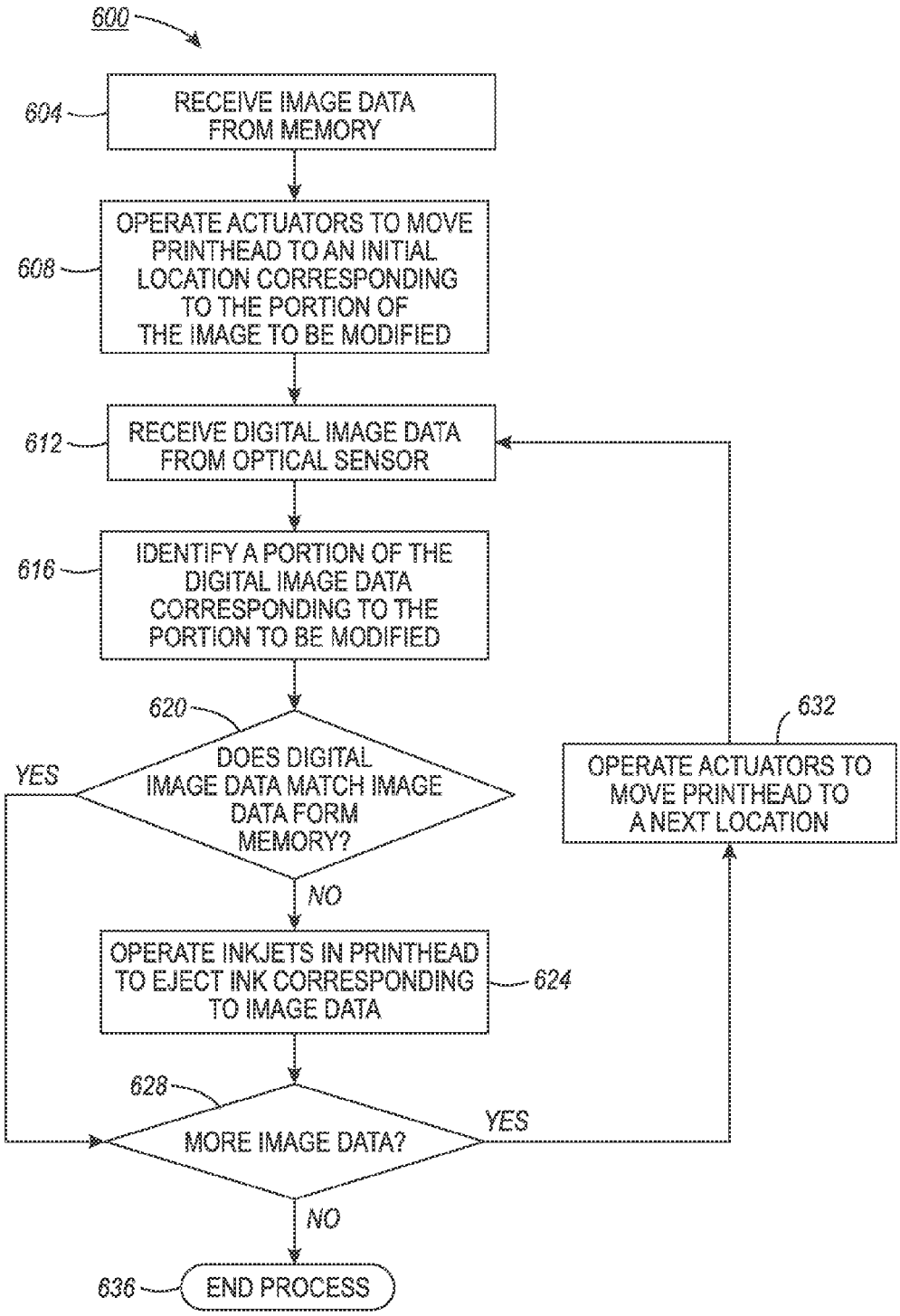
FIG. 5 is a block diagram of another printing process for the portable imaging system of FIGS. 2 and 3.

FIG. 5 illustrates a process 600 for modifying an image existing on a printing surface. Process 600 is described with reference to the printhead assembly 270, actuators 230, 234, 238, optical sensor 280, image data from memory 412, and controller 404 of FIG. 2 and FIG. 3 for illustrative purposes. The process 600 begins with the controller 404 receiving image data from memory 412 representing an area to be printed on the printing surface (block 604). The image data 412 received for process 600 can be a modification, repair, or extension of an image already on the printing surface. The controller 404 operates the actuators 230, 234, 238 to move the printhead assembly 270 to an initial location corresponding to a portion of the image to be modified or otherwise changed (block 608). The controller 404 receives image data generated by the optical sensor 280 for a portion of the surface opposite the sensor 280 (block 612). The digital image data from the sensor 280 can be a complete or nearly completely printed area, or it can include a printed image on only a portion of the scanned area corresponding to an edge of another printed image. The controller 404 identifies a portion of the digital image data corresponding to the portion of the image to be changed (block 616) to position the printhead assembly 270. The controller 404 then compares the digital image data from the sensor with the image data to be printed (block 620). If the digital image data from the sensor does not correspond to the portion of the image to be changed, then the controller 404 operates the printhead assembly 270 to eject ink corresponding to the image data 412 (block 624). Once the ink corresponding to the image data 412 has been ejected, or if the sensed image already matches the image data 412, the controller 404 determines if there is more image data ready for printing (block 628). If there is additional image data ready, the controller operates the actuators 230, 234, 238 to move the printhead assembly 270 to the next position for printing (block 632) and the process continues from block 512. If there is no more image data, then the process terminates (block 636).

For the printing of some images, such as descriptive text and pricing information, the portable printer needs to be essentially horizontal. To facilitate placement of the printer on a surface, a level indicator can be incorporated in the device. The level indicator could be a simple bubble level or it can be a electronic level that provides visual or audible signals to identify the end that requires dropping or elevation to establish a level condition. Repairing or extending an image on an object requires alignment with the original image before printing begins. This alignment can be achieved even if the printer is offset or skewed by optically imaging and analyzing a portion of the image present on the surface and then electronically adjusting the orientation of the image to be printed on the surface. A small display panel can be incorporated in the device by, for example, fixing the display to the electronics module, to facilitate leveling of the device and/or providing other operation information, such as ink volume remaining or of a need to replenish the ink supply. The portable printer can be configured to require a power cord connection to an electrical outlet or the electrical power source can be incorporated in the device by including an onboard battery or an external battery connected to the device via an electrical cable. Suction cups may be pneumatically operated with an onboard pump or external vacuum source or the cups can be configured with a manual lever to produce a vacuum.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A printer comprising:

a frame having a first rail and a second rail, the first and the second rails being spaced from one another and being parallel to one another in first direction;

at least one other rail operatively connected between the first rail and the second rail in a second direction, the at least one other rail being configured to move in the first direction between the first rail and the second rail, the first direction and the second direction being orthogonal to one another in a same plane;

a printhead operatively connected to the at least one other rail and configured to eject ink onto a printing surface, the printhead being movable in the second direction along the at least one other rail; and an attachment mechanism operatively connected to the frame, the attachment mechanism being configured to selectively couple the frame to the printing surface to position the printhead a predetermined distance from the printing surface to enable the printhead to eject ink onto the printing surface.

2. The printer of claim 1 further comprising:

another rail extending operatively connected to the first rail and the second rail and the other rail being spaced from and parallel with the at least one other rail to enable the printhead to be positioned between the other rail and the at least one other rail for movement in the second direction.

3. The printer of claim 1 further comprising:

a first actuator operatively connected to the at least one other rail to move the at least one other rail and the printhead in the first direction; and a second actuator operatively connected to the printhead and configured to move the printhead along the rail in the second direction.

4. The printer of claim 3 further comprising:

a third actuator configured to move the printhead in a third direction orthogonal to the first and second directions to enable a change in a distance between the printhead and the printing surface.

5. The printer of claim 1, the attachment mechanism further comprising:

at least one suction cup.

6. The printer of claim 1, the attachment mechanism further comprising:

at least one clamp.

7. The printer of claim 1 further comprising:

a sensor operatively connected to the frame and configured to move within the frame to detect an image on the printing surface.

8. The printer of claim 7 further comprising:

a controller operatively connected to the printhead and the sensor being configured to operate the printhead to eject ink in response to the image detected by the sensor.

9. The printer of claim 8, the controller configured to identify an edge of the image detected by the sensor and to operate the printhead to eject ink adjacent to the identified edge.

10. The printer of claim 8 further comprising:

a third actuator configured to move the printhead in a third direction orthogonal to the first and second directions; and the controller being further configured to operate the printhead to eject a plurality of layers of phase change ink onto the printing surface and to move the printhead in the third direction to enable the printhead to change a distance between a top layer of ink and the printhead.

11. The printer of claim 1 further comprising:

a level operatively connected to the frame and configured to identify an orientation of the frame.

12. A method of printing comprising:

attaching a frame having a first rail and a second rail that are spaced apart and parallel to one another to a printing surface, the first and second rails of the frame being oriented in a first direction;

moving a printhead operatively connected to a third rail within the frame in a second direction, the third rail extending between the first and the second rails of the frame in the second direction and the first direction and the second direction being orthogonal to one another in a same plane;

moving the third rail and the printhead within the frame in the first direction; and operating the printhead to eject ink on the printing surface to form an image as the third rail and the printhead move in the first direction and the printhead moves along the third rail in the second direction.

13. The method of claim 12 further comprising:

actuating at least one actuator operatively connected to the printhead to move the printhead along the third rail in the second direction.

14. The method of claim 12 further comprising:

moving the printhead in a third direction that is orthogonal to the first and second directions to position the printhead a predetermined distance from the printing surface.

15. The method of claim 12 further comprising:

generating with a sensor image data of an image on the printing surface.

16. The method of claim 15 further comprising:

identifying an edge in the image data that corresponds to an edge of the image on the printing surface; and operating the printhead to eject ink onto the printing surface adjacent to the image edge corresponding to the identified edge in the image data.

17. The method of claim 15 further comprising:

identifying at least one region in the image data that corresponds to at least one region in the image on the printing surface; and operating the printhead to eject ink onto the printing surface adjacent to the at least one region in the image on the printing surface that corresponds to the at least one region in the image data.

18. The method of claim 12 further comprising:

operating the printhead to eject phase change ink on top of previously ejected ink to generate a three dimensional image.

19. The method of claim 12 further comprising:

detecting with a sensor a distance between the printhead and the printing surface; and operating an actuator to position the printhead at a distance from the printing surface that is different than the detected distance.

* * * * *